United States Patent [19]

Fillingsness et al.

[11] Patent Number: 5,052,539

[45] Date of Patent: Oct. 1, 1991

[54] CIRCULAR ESCALATOR

[75] Inventors: Geoffrey S. Fillingsness; C. Christopher Brandt, II, both of Indianapolis; Raymond J. Cipra, West Lafayette, all of Ind.

[73] Assignee: Melvin Simon & Associates, Inc., Indianapolis, Ind.

[21] Appl. No.: 426,749

[22] Filed: Oct. 24, 1989

[51] Int. Cl.[5] ..... B66B 21/00

[52] U.S. Cl. ..... 198/328; 198/323; 198/330; 198/333

[58] Field of Search ..... 198/328, 325, 323, 329, 198/330, 333, 321, 326; 104/25

[56] References Cited

U.S. PATENT DOCUMENTS

| | | | |
|---|---|---|---|
| 792,623 | 6/1905 | Souder . | |
| 889,080 | 5/1908 | Wheeler | 198/328 |
| 984,495 | 2/1911 | Seeberger . | |
| 999,885 | 8/1911 | Seeberger . | |
| 1,956,154 | 9/1932 | Lindquist et al. . | |
| 2,402,056 | 2/1944 | King . | |
| 2,641,351 | 6/1953 | Riley . | |
| 2,695,094 | 11/1954 | Riley . | |
| 2,823,785 | 2/1958 | Hefti | 198/333 X |
| 3,144,118 | 8/1964 | Fabula . | |
| 3,233,717 | 2/1966 | Jin et al. . | |
| 3,878,931 | 4/1975 | Luna . | |
| 3,986,595 | 10/1976 | Asano et al. . | |
| 4,004,467 | 1/1977 | Kenney . | |
| 4,088,219 | 5/1978 | Binns . | |
| 4,362,232 | 12/1982 | Saito et al. | 198/333 |
| 4,397,383 | 8/1983 | James . | |
| 4,413,719 | 11/1983 | White . | |
| 4,434,884 | 3/1984 | Kettle | 198/328 |
| 4,470,497 | 9/1984 | Kraft . | |
| 4,483,432 | 11/1984 | Ishida . | |
| 4,486,987 | 12/1984 | Naka . | |
| 4,519,490 | 5/1985 | White . | |
| 4,565,276 | 1/1986 | Dengs et al. . | |
| 4,653,633 | 3/1987 | Jacobs . | |
| 4,662,502 | 5/1987 | Nakatani . | |
| 4,669,597 | 6/1987 | Langer et al. . | |
| 4,746,000 | 5/1988 | Nakatani et al. . | |
| 4,756,398 | 7/1988 | Watanabe et al. | 198/333 X |
| 4,775,043 | 10/1988 | Tomidokoro . | |
| 4,805,757 | 2/1989 | Wilcox . | |
| 4,809,840 | 3/1989 | Nakatani . | |

FOREIGN PATENT DOCUMENTS

| | | | |
|---|---|---|---|
| 2161442 | 7/1972 | Fed. Rep. of Germany | 198/333 |
| 2135864 | 1/1973 | Fed. Rep. of Germany | 198/323 |
| 2346266 | 3/1975 | Fed. Rep. of Germany | 198/333 |
| 2809861 | 9/1978 | Fed. Rep. of Germany | 198/328 |
| 2506280 | 11/1982 | France . | |
| 52-41380 | 3/1977 | Japan . | |
| 2044714 | 10/1980 | United Kingdom | 198/333 |
| 2061215 | 5/1981 | United Kingdom | 198/333 |

OTHER PUBLICATIONS

"Early Risers", *American Heritage of Invention & Technology,* Winter, 1989, pp. 40–44.

"Along the Way/Shopping", *Vis a Vis,* Oct. 1989, p. 28.

*Primary Examiner*—Robert P. Olszewski

*Assistant Examiner*—James R. Bidwell

*Attorney, Agent, or Firm*—Woodard, Emhardt, Naughton Moriarty & McNett

[57] ABSTRACT

A single endless series of steps for up and down flights has inboard end spacing.control links, each operated by a gear arrangement at transitions between curved and straight paths of step travel. Steps are molded plastic cores with top mounted tread caps, both the cores and caps being of colors as desired, and with light transmission characteristics from opaque to transparent, as desired. Inter-engaging edges on treads and risers are of curved shape facilitating the transition from straight to curved runs of steps. Break-away stripper comb fingers at landings terminate escalator operation when an object becomes jammed between a step and a finger and breaks a finger. Spring-loaded skirt guards at the sides of steps, and step spacing monitors, include wear indicators. The ascending and descending flights of steps are supported by structural tubes extending between floors, with no other support for the flights. Stabilizer legs, rollers and tracks under the steps maintain the horizontal attitude of the steps. Escalator drive is by belt and rack through the links in one embodiment, and by individual motor-gear sets in the steps driving on stationary curved racks in the other embodiment.

36 Claims, 13 Drawing Sheets

CIRCULAR ESCALATOR

BACKGROUND OF THE INVENTION

1. Field of the Invention

This invention relates generally to escalators and more particularly to a circular escalator.

2. Description of the Prior Art

The concept of curved escalators has existed and been known to the public since early in the 20th century. Various efforts have been made to construct such devices. United States and foreign patents have been granted on curved escalators and various aspects thereof. One of the early patents of that nature is U.S. Pat. No. 999,885, issued Aug. 8, 1911 to Charles D. Seeberger. In that patent, a single endless series of steps runs in duplex spirals about a common well or center of curvature and is employed for conveying passengers on both the ascending and descending spiral runs. At any given floor, the entry to and exit from that escalator are at locations which are about diametrically opposite each other in the circle in which the escalator operated. More recent patents to Riley, U.S. Pat. No. 2,641,351, issued Jun. 9, 1953 and U.S. Pat. No. 2,695,094, issued Nov. 23, 1954, disclose a moving stairway operating in a circle and where the entrance to the ascending flight is at approximately the same location as the exit from the descending flight in a single endless series of steps. Although it is evident that the concept of a curved escalator has been known for many years, curved escalators have not enjoyed widespread adoption and use. There has remained a need for a relatively low-cost, light-weight system which, in addition to its utilitarian people-transporting function, can provide a variety of desirable esthetic effects.

SUMMARY OF THE INVENTION

Described briefly, according to a typical embodiment of the present invention, a circular escalator operating between landings on vertically spaced floors employs a single endless series of people-transporting steps. Adjacent steps are provided with spacing control links, each operated by a gear arrangement at regions of transition between curved and straight paths of movement of the steps. Steps are preferably made of molded plastic of colors as desired, and with light transmission characteristics from opaque to transparent, as desired. Interfitting ridges and grooves on step treads and risers are of curved shape facilitating the transition from straight to curved runs of steps. Break-away stripper comb fingers at landings terminate escalator operation when an object becomes jammed between a step and a finger and breaks the comb or finger. Spring-loaded skirt guards are provided at the sides of steps. Wear indicators are provided on them and on step-spacing monitors. The ascending and descending flights of steps are supported by structural tubes extending between floors. Constant riser heights are maintained through much of the step travel. Stabilizer legs and guide rollers thereon, and associated tracks under the steps, maintain level tread tops.

DESCRIPTION OF THE PREFERRED EMBODIMENT

Figure 1:
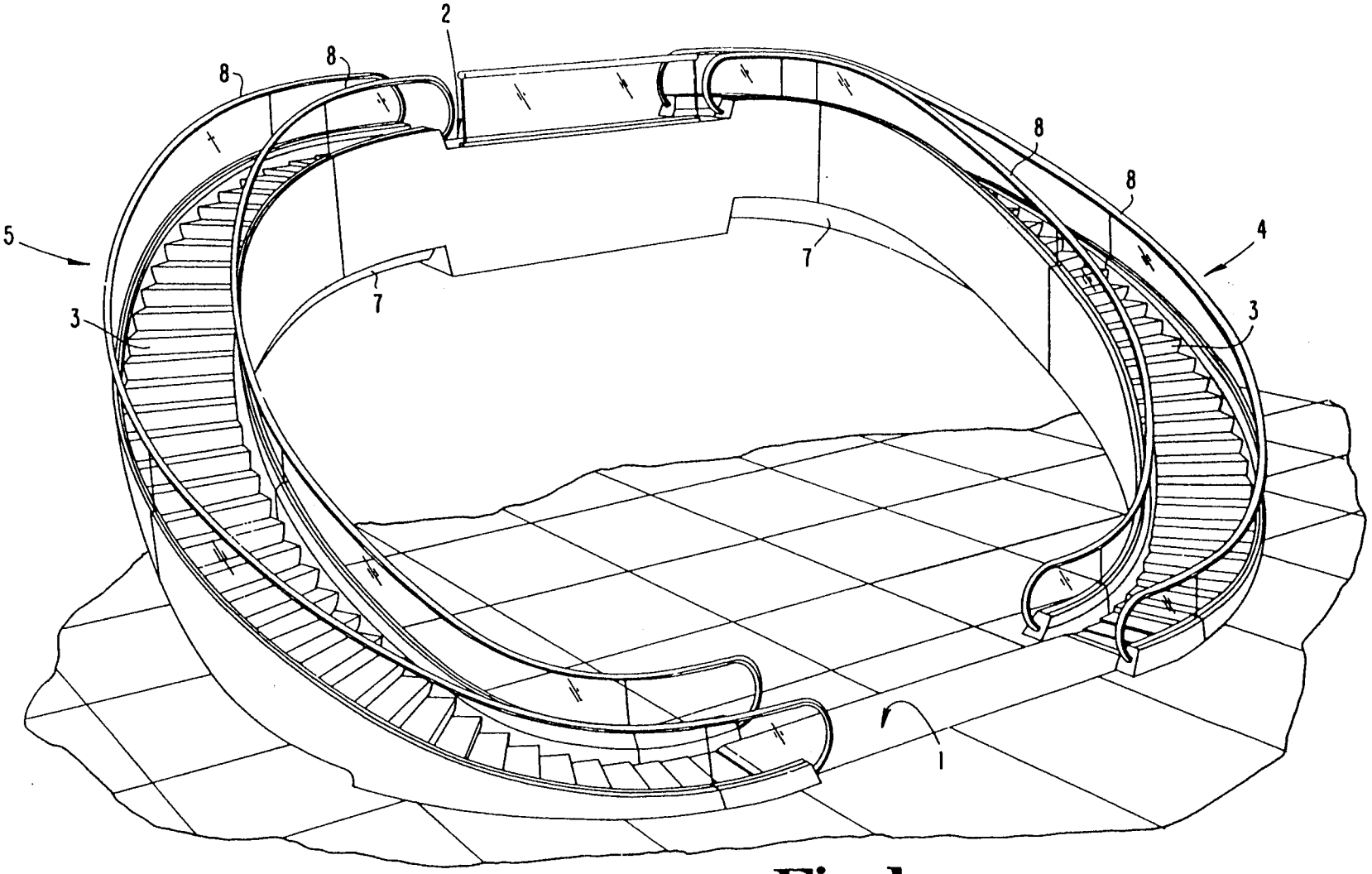
FIG. 1 is a frontal pictorial view of a curved escalator installation according to our invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
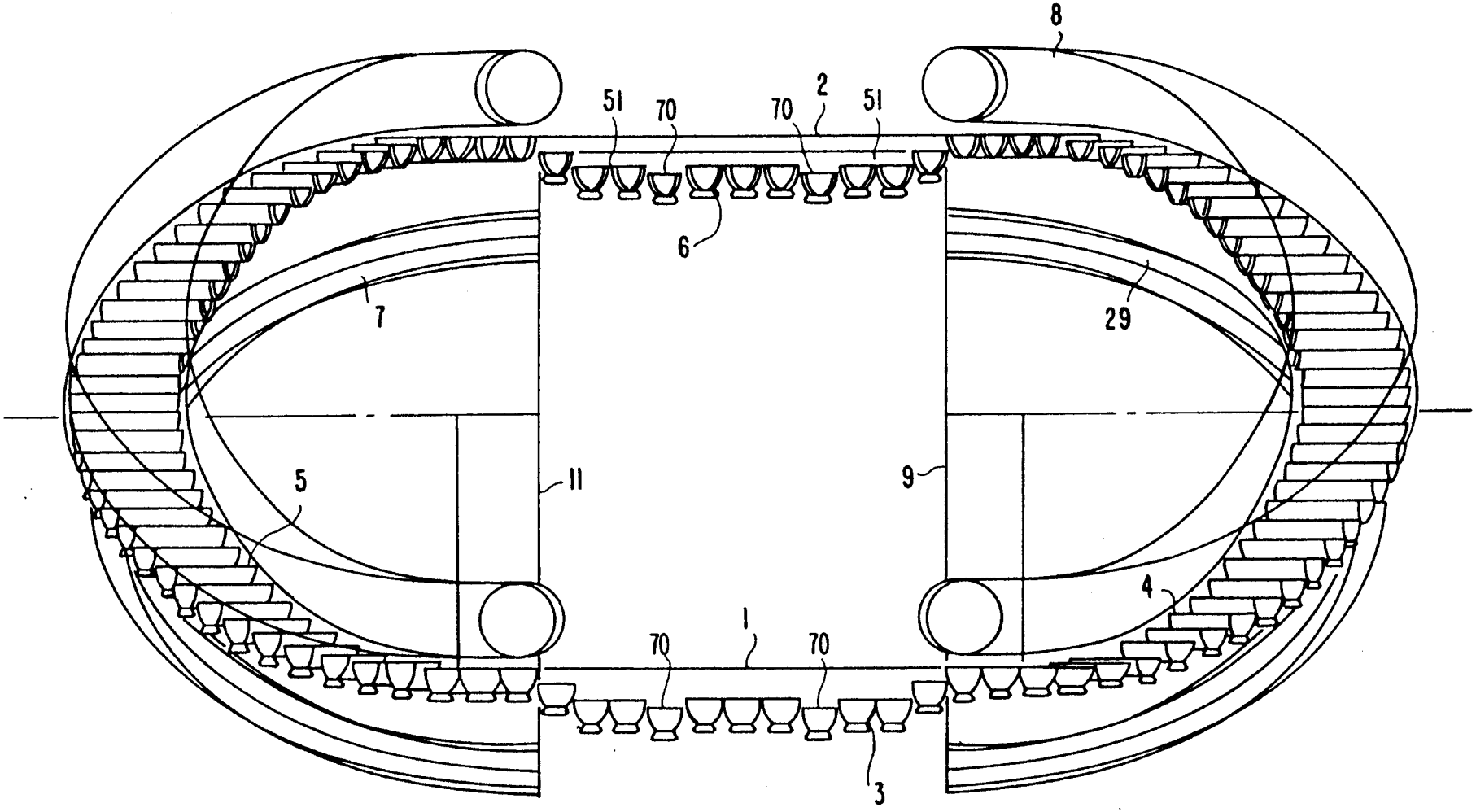
FIG. 2 is a front elevational view of the endless belt assembly of steps of the escalator as installed between two floors of a building, the support system, hand rails, and landings being shown schematically.

Referring now to the drawings in detail, FIGS. 1 and 2 show a portion of a building structure with two vertically spaced floors flush with the landings 1 and 2 at the first and second floor entrances and exits of the escalator. The escalator comprises an endless series of steps 3 connected by links between adjacent steps and operating in a counterclockwise direction when viewed from above as in FIG. 3. Consequently, the ascending flight 4 is at the right, and the descending flight 5 is at the left in the figures. At the landings 1 and 2, the steps are concealed below the floor as shown at 3 and 6, respectively in FIG. 2. The overall support for the ascending and descending flights is provided by a couple of structural tubes as at 7, and which provide support for associated shrouding of the steps and the moving hand rails 8.

Figure 3:
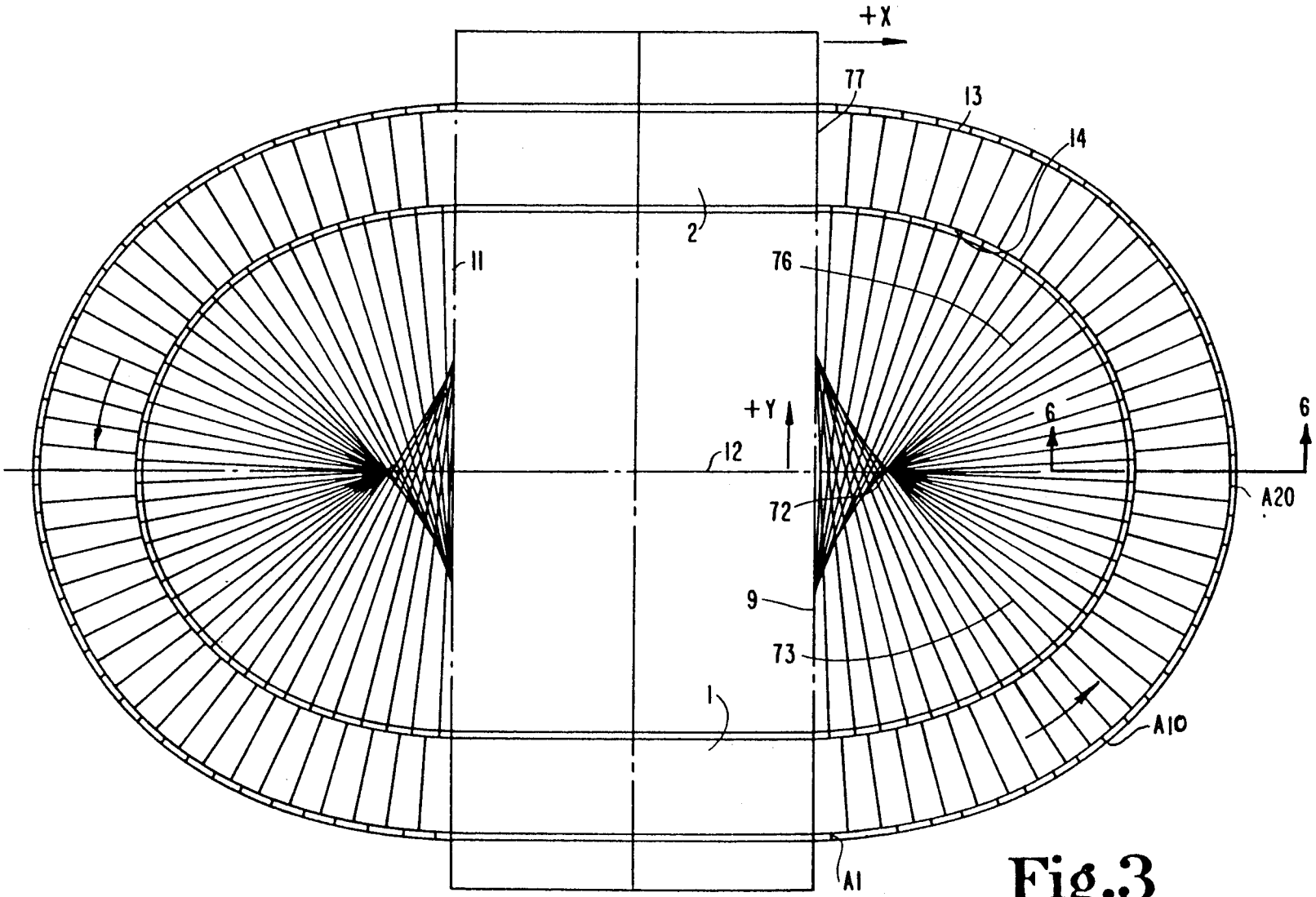
FIG. 3 is a schematic top plan view of the visible portion of the step assembly operating between the landings and showing the locii of the centers of curvature at various locations around the path of steps.
Figure 4A:
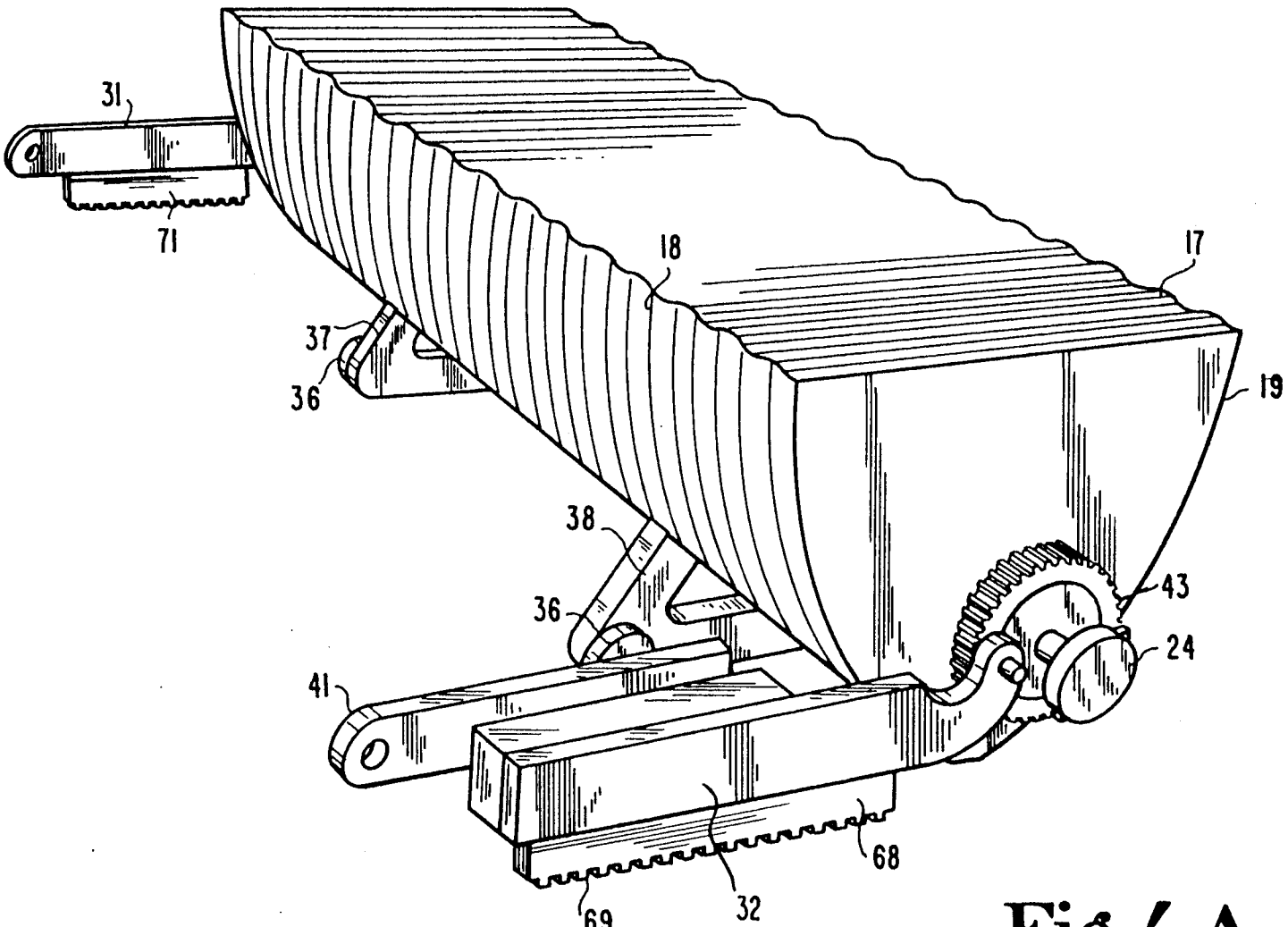
FIG. 4A is an enlarged pictorial view of one of the step assemblies, looking downward and outward from the inside of the curved path.
Figure 4B:
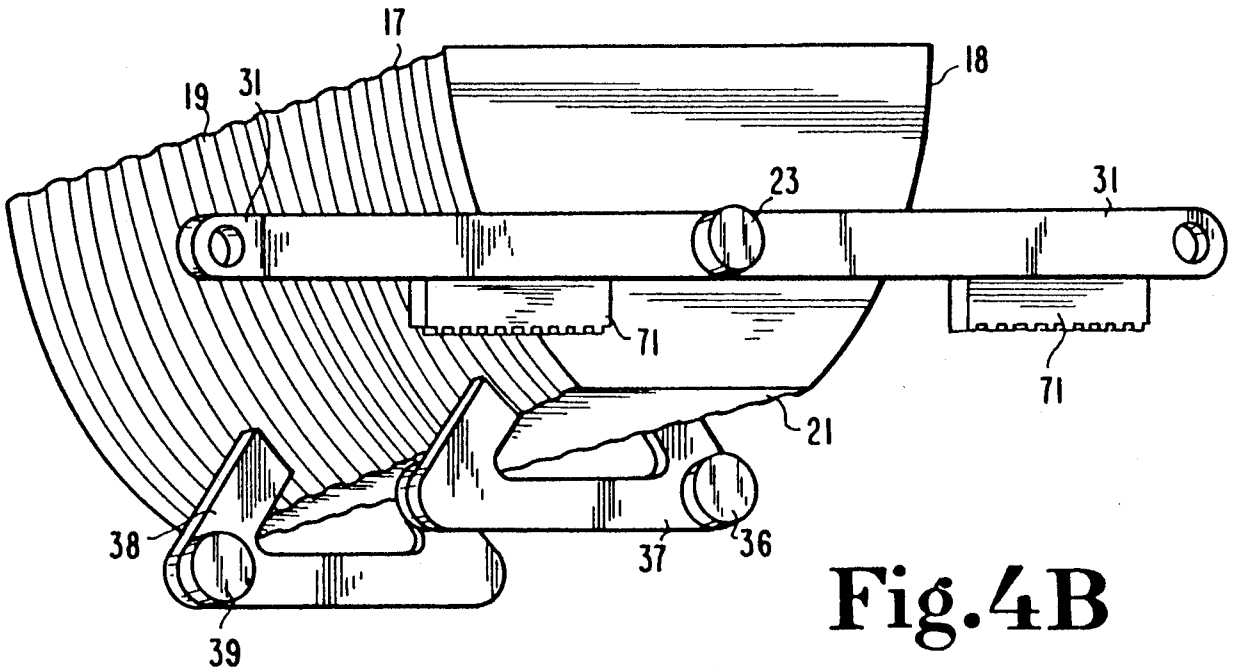
FIG. 4B is a view of a step assembly on the same scale as FIG. 4A but looking upward and inward from the outside of the curved path.
Figure 5B:
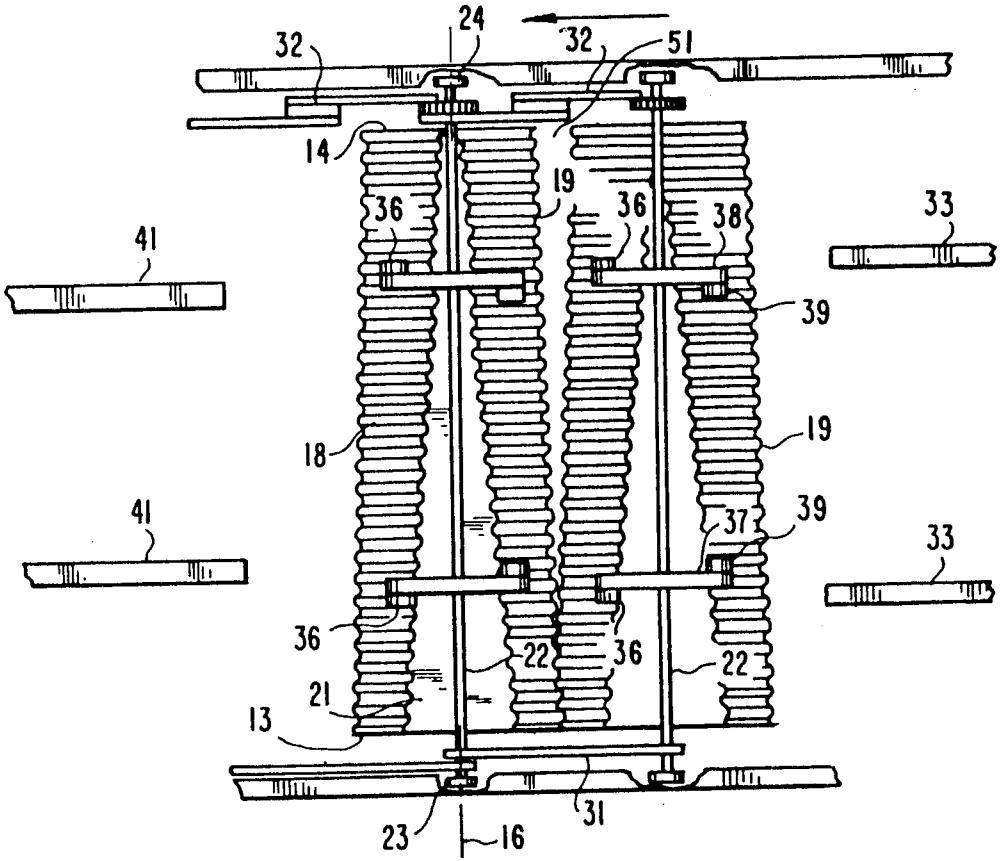
FIG. 5B is a bottom plan view of two of the steps splayed as they are while passing under the landing.

As shown in FIG. 3, the curved path of the ascending flight begins and ends at a vertical plane 9. The curved path of the descending flight begins and ends at the vertical plane 11. The radius of curvature varies from a maximum at infinity in planes 9 and 11 to a minimum in the vertical plane 12. For convenience in achieving this effect, the tops (treads) of the steps converge slightly from the outside curve (outboard) end 13 to the inside curve (inboard) end 14, for example, as shown in FIG. 3 and in the enlarged bottom views of FIGS. 5A and 5B, for example. Each of the steps has a hollow core (FIG. 6) that is symmetrical about a vertical plane 16 (FIG. 5B) and has a tread surface 17 in a cap screwed onto the top of the core, and riser walls 18 and 19 at the front and rear of the step core. A reference to the front and rear of the steps and associated components identifies them in relation to the direction of motion of the escalator. Due to the convergence of the step tread from the outboard end 13 to inboard end 14, the flat bottom 21 of the step has a triangular shape. The result of this is that in FIG. 4B herein, the tread and bottom appear to converge toward each other, but in fact they lie in parallel planes as is shown in the elevational view of the step in the assembly in FIG. 6.

Figure 6:
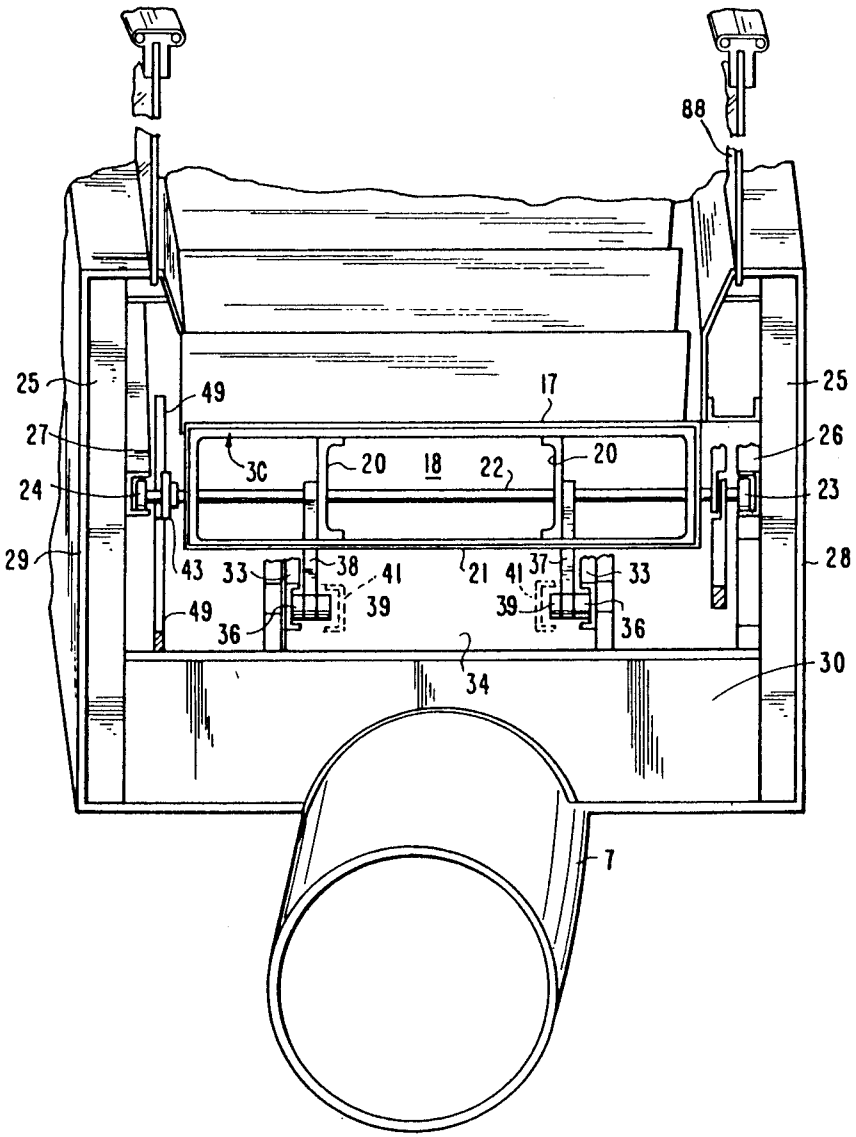
FIG. 6 is a cross section through the ascending flight of the escalator assembly.
Figure 9:
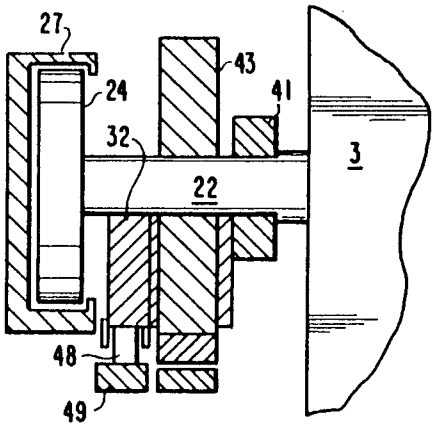
FIG. 9 is a vertical sectional view showing some details of the splaying devices.

Each step is provided with a shaft 22 extending through it on its axis of symmetry, and it is slightly farther from the top tread surface 17 than it is from the bottom 21, as shown in FIG. 6. This shaft has rollers 23 and 24 at the outboard and inboard ends, respectively. These rollers are guidingly received in channel-shaped tracks 26 and 27 secured to framework 25 located immediately inside of the walls 28 and 29 of the escalator housing. Framework 25 is fastened to a series of structural support plates 30 longitudinally spaced and secured atop the steel support tube 7 whose base is fixed in the first floor adjacent the landing, and whose upper end is fixed in the second floor of the building adjacent the landing.

It is one feature of the present invention to make the steps of molded plastic hollow cores with closed ends, open tops and internal webs 20. The shafts 22 can be mounted in the steps in any suitable way. The plastic material for the cores and tread caps can be of any desired color, and can vary in clarity from opaque to transparent, depending upon esthetic effects desired. The type of plastic can be selected for the performance desired, and may be thermoplastic or thermosetting, with or without fillers for reinforcement, and molded by a suitable conventional process, with anti-slip materials molded in or permanently bonded to the tread top surface. Such plastic tread caps may also be used to retrofit existing conventional escalators.

Figure 19:
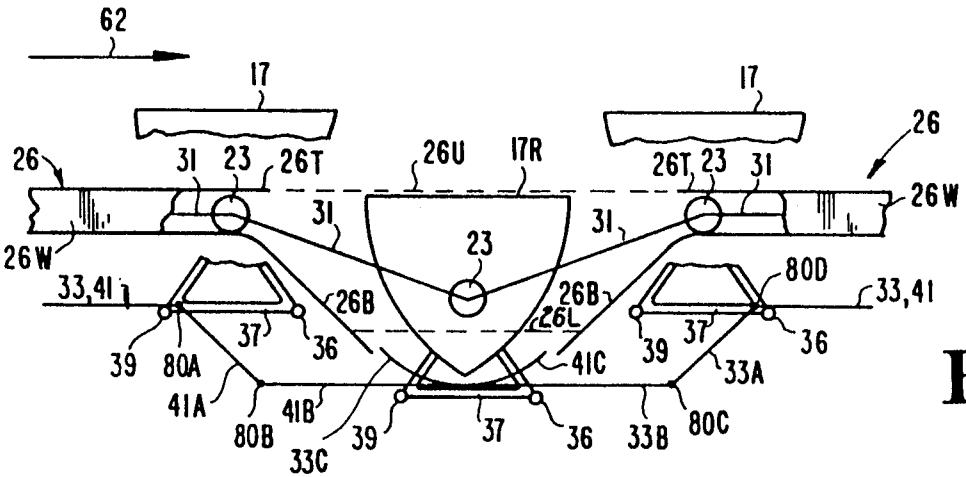
FIG. 19 is a diagrammatical elevational view of a velocity compensating portion of the escalator under the first floor landing.

The steps are connected in series by links connected to the shafts 22. These include outboard links 31 and inboard links 32. The outboard links are of fixed length and are simply mounted to the shafts between adjacent steps so that one step pulls the step behind it, which pulls the step behind it, and so on. The inboard links are mounted in a different arrangement to provide splaying of the steps during transition between a curved path and a straight path. Before describing that function in detail, it should be mentioned that the horizontal attitude of the step treads at all locations on the ascending and descending flights is maintained by roller and track arrangements under the steps. For example, for the ascending flight, channel-shaped tracks 33 are attached to the plates 30 inside the step housing. These tracks receive rollers 36 at the front of the outboard and inboard stabilizer legs 37 and 38 of each of the steps. On the descending flight of steps, the horizontal attitude of the tread is maintained by the rolling engagement of rollers 39 of legs 37 and 38, with tracks 41 (shown dotted in FIG. 6 to show the location, although they are not provided on the floor 34 of the ascending run). Tracks 41 are attached to plates 30 on the tube 7 under the descending run in the same manner as shown dotted in FIG. 6. Tracks 33 are omitted from the descending run. During the movement of the steps down under and up from under the landings 1 and 2, tracks 33 and 41 are provided at the locations required to maintain the horizontal attitude of the tread to the extent desired, regardless of whether the step is moving up or down or horizontally. There are areas directly under the landings where both sets of tracks 33 and 41 can be provided for engagement of the rollers 36 and 39, respectively as shown schematically at both sides of the dip in FIG. 19. The particular design and clearances of the tracks may be selected as needed, depending upon the desired precision of horizontal attitude maintenance in those locations where the treads are hidden from view. Vertical adjustment means may be provided at all locations of attachment of tracks 26, 27, 33 and 41 to stationary structure, to compensate for variations in installations and provide desired smooth operation.

Figure 8:
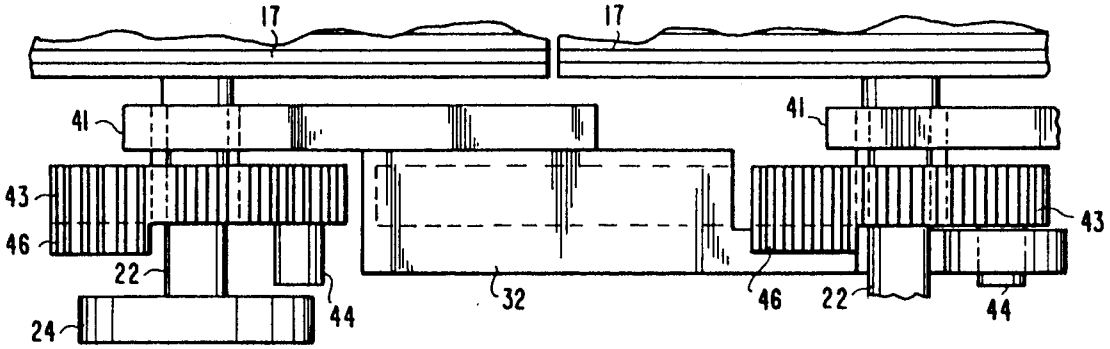
FIG. 8 is a fragmentary top plan view of the devices shown in FIG. 7.
Figure 7:
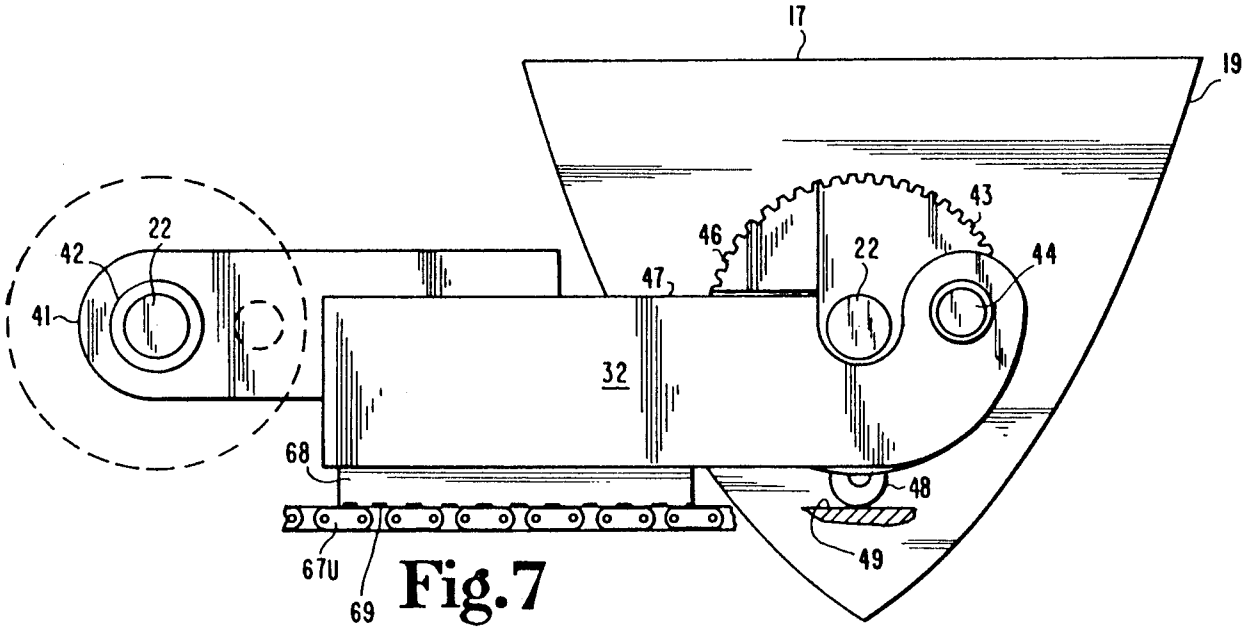
FIG. 7 is an enlarged elevational view of a step inboard end with splaying devices.

It was mentioned above that the outboard ends of the steps are connected by links 31 of fixed length. Although the inboard ends of steps are connected by links, the arrangement is a bit different from the outboard end as is best shown in FIGS. 4A through 5B and 7 through 9. It can be most readily understood with reference to the second floor landing 2 and what occurs at that location. It was mentioned above that there is a transition from the curved path in the ascending flight at the vertical plane 9 at the second floor. Since the treads have a tapered shape as viewed from above, the space between the trailing edge of one tread and the leading edge of the next tread at the inboard end of the step must increase as the radius of the path goes to infinity. This effect is called spreading or splaying of the steps. To achieve this, the mounting of the links 32 to the step axles 22 is different from that for links 31. More specifically, the front end 41 of link 32 is mounted by a spherical bearing 42 to the shaft 22 of one step as are the ends of links 31. But each shaft also has mounted to it adjacent the inboard end, a sprocket or gear 43 which is also mounted to the shaft 22 by a spherical bearing, so that the gear is free to rotate on the shaft 22. The rear end of each link is mounted to this gear by means of a pin 44 fixed to the gear and received through a bushing in the link. The gear has a sector-shaped stop boss 46 projecting outward from it in the same direction as pin 44. This boss is abuttingly engageable with the top surface 47 of the link as shown in FIGS. 7 and 8 to limit rotation of the gear with respect to the link in the counterclockwise direction. A support roller 48 is mounted on the bottom of the link and is situated to run on a rail 49. Rail 49 engaged by roller 48 prevents clockwise rotation of the gear 43 with respect to the step and "unwrapping" of the link from the axle 22, as will now be described.

Figure 5A:
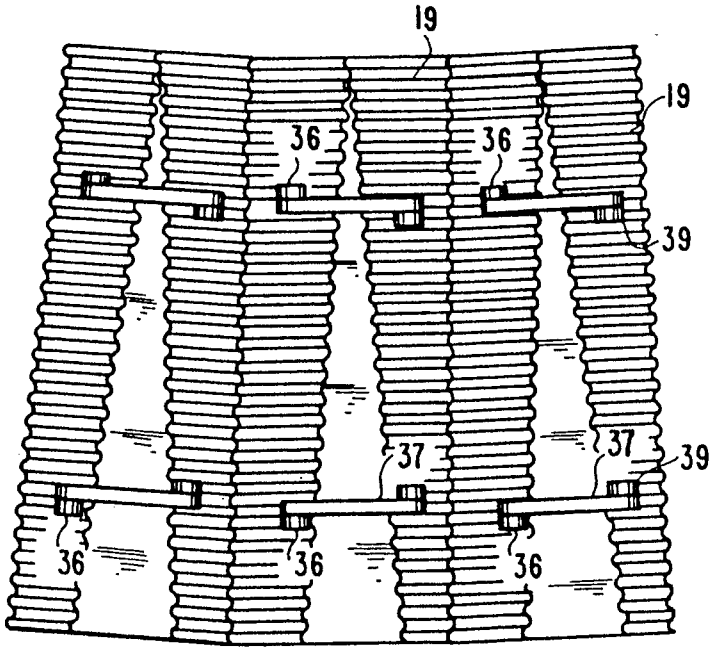
FIG. 5A is a fragmentary bottom plan view of three of the steps as they ascend toward the second floor landing.
Figure 10:
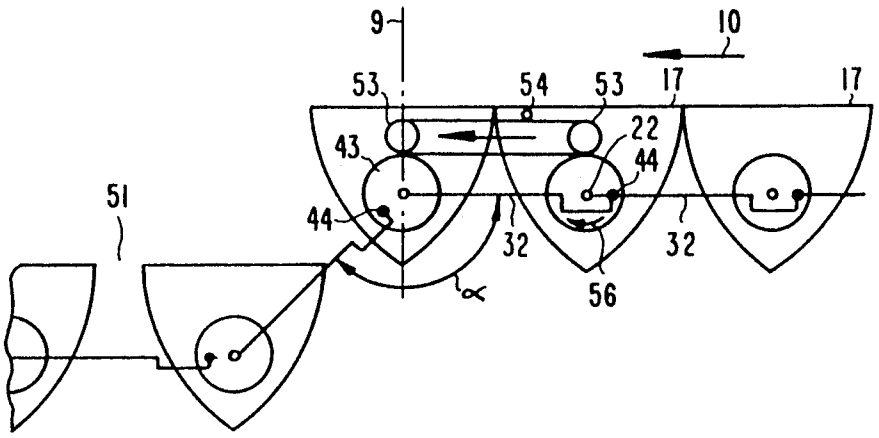
FIG. 10 is a schematic elevational view of a portion of the escalator at a landing, showing the end splaying feature.
Figure 11:
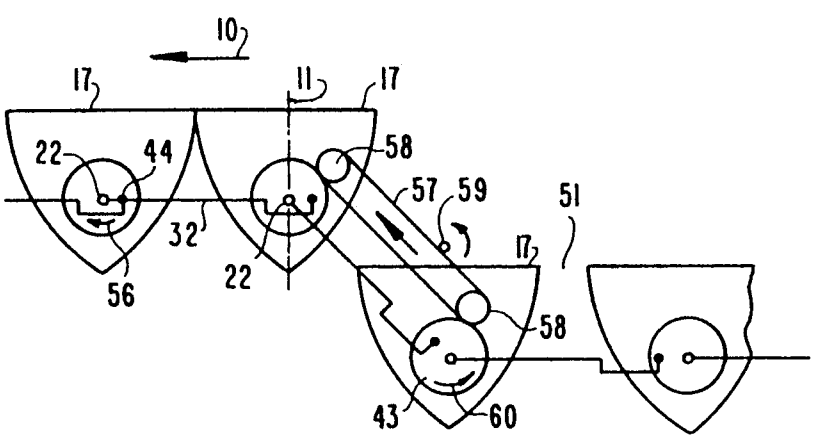
FIG. 11 is a view similar to FIG. 10 and showing further progress of the steps in motion.
Figure 11:
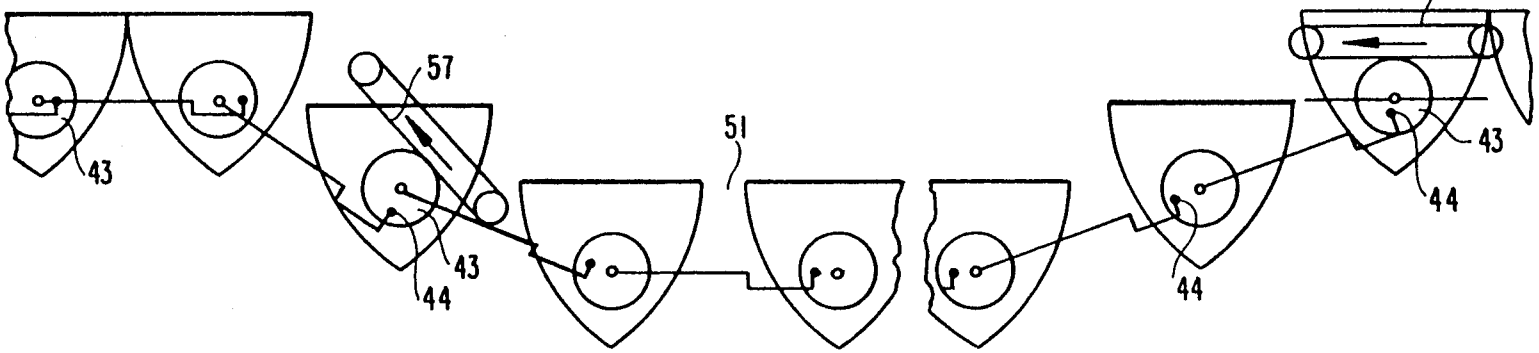

Referring now to FIG. 10, there is shown schematically, the organization of the steps as they descend to the space below the landing as at 2 in FIG. 2, and then ascend from that space to the entrance of the descending flight of steps. For relating FIG. 10 to FIGS. 2 and 3, the vertical planes 9 and 11 are shown in FIG. 10. The direction of the travel of the steps is to the left as shown by arrow 10. The links at the inboard ends of the steps are situated exactly as shown in FIG. 7, where the trailing edge of each tread is immediately adjacent and almost touches the leading edge of the next following tread. It should be understood that these respective edges are provided with interfitting vertically extending cleats as is known to provide cleats on the treads of conventional escalators and on the risers of next adjacent steps to avoid a gap and maintain alignment of each step with the next preceding and next following step in the path of motion of the steps of the escalator. This is shown in FIG. 5A. Due to the changing radius of the step path to infinity at the landings, it is necessary to splay the inboard ends of the steps at the landings, resulting in spacing of the inner ends as shown at 51 in FIGS. 5B and 10. To accomplish this, a gear belt or chain 52 is mounted through guide wheels 53 and associated shafts to the housing framework 25 inside wall 29 (FIG. 6) adjacent the landing 2. This belt is driven in a clockwise direction at ½ the lineal speed of the treads for example, by a counterclockwise powered drive pinion 54 engaging the upper flight of the belt and driving it to the right in the direction opposite arrow 10. As the steps moving in the direction of arrow 10 approach this belt, the gear 43 for the step will engage the belt and begin to be rotated clockwise in the direction of arrow 56. As this occurs, the pin 44 on the gear begins to drive the rear end of the link 32 clockwise with respect to the step axle 22, thus "unwinding" the link from around the axle. This occurs until the gear 43 leaves the belt 52 which happens at the plane 9. As the unwinding occurs, the distance between the axle 22 of one step, and the axle 22 of the following step, is increased by two times the radius from axle 22 to the center line of the pin 44 of the following step. This provides the needed splaying action for the steps. The linear velocity of the belt 52 is established such that, combined with the linear velocity of the steps, it will produce the desired splaying effect between the time of contact of the gear 43 with the belt and the time that contact with the belt 52 ceases. Gear 43 rotates through the angle alpha ($\alpha$ in FIG. 10). FIG. 11 shows one stage in the progress of one of the gears 43 from the first contact with belt 52 to the end of contact with belt 52.

Referring now to the left-hand end of FIG. 10, the apparatus for termination of the splaying effect is illustrated. In this case, another chain or gear belt 57 is shown mounted to guide wheels 58 mounted to suitable shafts mounted in the step housing. This belt is driven in a clockwise direction by counterclockwise powered drive pinion 59 so that the lower run is moving upwards and faster than the gear center is traveling. When the gear 43 of the advancing step, engages this belt, it begins to be rotated in the counterclockwise direction of arrow 60 due to the lower linear speed of the step axle than the linear speed of the lower flight of the belt 57. By the time the step has risen to the point where its shaft axis lies in the vertical plane 11, its tread 17 is essentially co-planar with the tread of the preceding steps, the space between the inboard tread edges has been closed and thereby the splayed effect has been terminated. Then gear 43 leaves the belt 57. FIG. 11 shows one point in the progress of a gear 43 upward along the belt 57.

Figure 12:
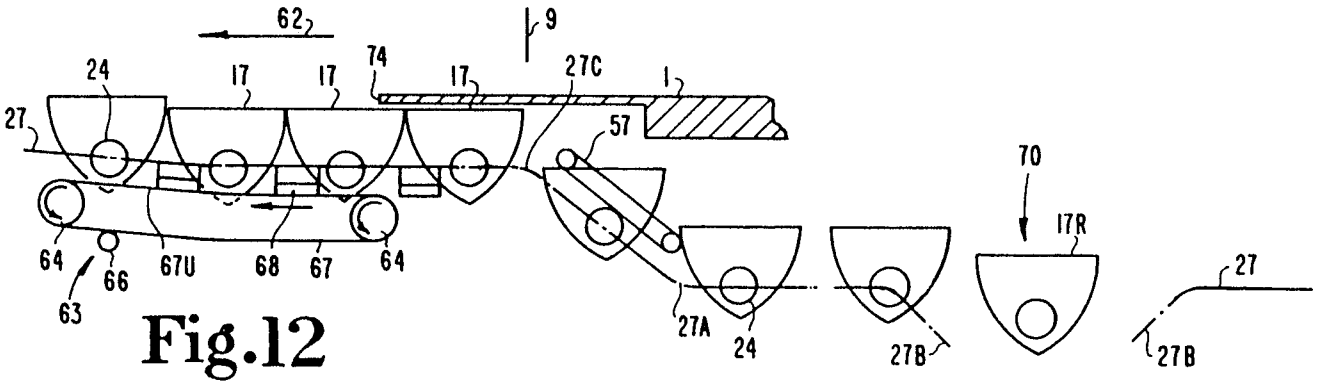
FIG. 12 is a view similar to FIGS. 10 and 11 but showing the nature of the drive for the escalator.

Referring now to FIG. 12, there is shown schematically one arrangement for drive of the steps as viewed from the inside at the first floor landing 1. The path of the main guiderail or track 27 is shown by the dashed lines. Note that there are gentle curves at 27A and 27C as the steps start up from below landing 1 and then level off adjacent landing edge 74. A dip and modification 27B of the track is shown at location 70 for velocity compensation as will be described herein. The splayed arrangement of the edges of the steps at their inboard ends has been terminated at vertical plane 9 by an apparatus as described above with reference to FIGS. 10 and 11, and particularly belt 57 which, operating through the gears and cranks on the inboard ends of the steps causes the links to wrap around the axles and close up the horizontal space between the tread edges at the inboard ends of the steps. Therefore, there are essentially three steps whose treads 17 are co-planar beginning at the vertical plane 9 and moving away from the landing 1 in the direction of arrow 62.

Figure 15:
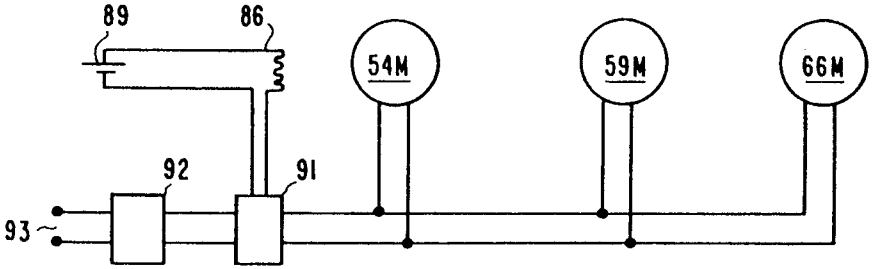
FIG. 15 is a schematic diagram of the safety circuit employing the stripper comb.

To drive the steps, a chain drive assembly 63 is Provided in the housing 28, 29, 34 (FIG. 6) at the exit from the landing 1. It includes chain guides 64 and a powered drive sprocket 66, typically powered by an electric or hydraulic motor 66M (FIG. 15). The rotational direction of the drive sprocket is clockwise so the chain is driven counterclockwise whereby the upper flight of the chain 67 is moving to the left in the direction of arrow 62.

It was mentioned above with reference to FIGS. 7, 8 and 9, that there is a rack attached to each of the links 32. More specifically, the rack 68 is mounted to the bottom of link 32 and the teeth 69 on the rack engage the drive chain upper flight 67U. Two steps, for example, have their link-mounted racks 68 engaging and driven by the upper flight of the chain. For security against the clockwise turning of the gear 43 and unwinding of the link as a result of the commencement of rack drive by the drive chain 67 or the pulling of the preceding link, the roller 48 on the bottom of each link under the rear end of the link can roll on the track 49, FIGS. 7 and 9, and prevent the unwinding from happening at any place throughout the entire length of track, the track 49 being co-extensive with the support track 27, and can be extended up the ascending and down the descending flights in the conveyor housing. Chain drive assemblies of this type can be provided not only at the escalator entrance end of the first floor landing, but also at the escalator exit end of the second floor landing. Similarly, these assemblies can be provided at the escalator entrance end on the second floor landing and at the escalator exit end on the first floor landing. Also, where provided at the inboard end of steps, such chain driven assemblies are also provided for racks 71 on the bottoms of links 31 at the outboard ends of the steps.

In order to compensate for velocity variations in the steps due to descending under and ascending from below the landings, and for automatic adjustment purposes, a take-up device using gravity, is employed at two locations 70 under each of the landings 1 and 2. At each of these locations, a dip and hiatus is provided in each of the axle roller guide tracks 26 and 27. As shown looking from the inside out in FIG. 12 for track 27, and more specifically, looking in from the outside at the same step in FIG. 19 for track 26, the top flange 26T of the track is eliminated at these locations, the bottom flange 26B is dropped well below the lowermost point to which the links 31 will permit the rollers 23 and 24 to descend, and the vertical wall of the track 26W (broken away to show links 31 and rollers 23) may be continued and expanded vertically in the area between dotted lines 26U and 26L to the extent desired to maintain lateral control of the rollers 23 and 24 at opposite ends of the axle as the step moves along through the dip region.

As the steps move to the right in the direction of arrow 62, and when the rollers 23 and 24 reach the dips in the tracks 26 and 27 they are free to descend down the bottom flanges of the tracks such as 26B until they are no longer supported by the bottom flanges, but are suspended by the links 31 at one end of the step and links 32 at the opposite end. In order to keep the tread level, the tracks 41 and 33 are modified at the dips as shown and as will be described now.

Tracks 33 and 41 extend from the left to a point 80A (FIGS. 19 and 20) where they stop. At that point, the top flange and vertical wall 41W of the track 41 continue on first track extension section 41A, hinged to track 41 at 80A, but the bottom flange may be eliminated. A second track extension section 41B is hinged to section 41A at 80B. It has an upwardly curved end portion 41C. A torsional spring indicated schematically at 80A applies clockwise torque on guide section 41A so that its top flange urges rear stabilizing roller 39 of each step downward as the step begins to drop, due to gravity, where the axle support track flange 26B dips. Thus the step won't tip downward. The top flange of extension 41B will continue to guide roller 39 until the front roller 36 of the step engages the upturned entrance end portion 33C of front roller guide track section 33B which is hinged at 80C to roller guide track section 33A which is hinged at 80D to track 33. Track sections 33A, B and C can be identical to 41A, B and C. A torsional spring is used at hinge 80D to apply counterclockwise torque on track section 33A to maintain a downward load on the top of front roller 36 as the step 17R rises on axle guide bottom flange 26B to the normal track level under landing 1. This is to prevent the step from tipping upward as it rises.

It is desirable that the guide sections 41B and 33B remain horizontal at all times while the intermediate guides 41A and 33A pivot about hinges 80A and 80D, respectively. To facilitate this, while accommodating the linear motion of sections 41B and 33B relative to each other in the direction of arrow 62 a restraining device is provided. This includes a C-shaped bracket 85A fastened to the top flange and vertical wall of guide section 33B. A generally C-shaped bracket 85B is fastened to the top flange and vertical wall of guide section 41B. The lower leg of bracket 85B has an outwardly opening horizontal slot 85C providing a guide groove slidingly receiving the lower leg of bracket 85A, thereby keeping the guide portions 41B and 33B in horizontal alignment while permitting relative movement between them in the horizontal direction lengthwise of the tracks.

It will be evident from inspection of FIGS. 1-3 that the escalator of the present invention provides an open, attractive, and inviting system. There are no abrupt transitions of the type evident in FIG. 22, for example, of U.S. Pat. No. 4,746,000 issued May 24, 1988 to Nakatani et al. This is achieved according to other aspects of the present invention, by varying the amount of step rise which causes the centers of curvature of various portions of the path and hence the radius of curvature to change as shown in FIG. 3. This is due to the fact that the links between steps do not change length in these portions of the path. The radial lines from the various centers indicate extensions of the axes of the shafts of the steps. The up ramps are provided by the tracks 26, 27 and 33. The radii of the various points in the curved path defined thereby, commence at infinity in plane No. 9 and decrease to a center on vertical line 72 lying in vertical plane 12 and parallel to plane 9, and are uniform through a sector beginning at radius 73, for axle A-10 which is the tenth axle out from plane 9. This radius is used through that sector to and including radius 76. In this portion of the ascending flight of steps, the riser height from step to step is uniform. Then it decreases throughout the remaining ascending flight to the entrance end 77 of the second floor landing 2. This enables a substantially flush relationship of the inboard end of each step with that of the next succeeding and following step, as is true also of the outboard ends of the steps. As an example, where there are forty steps in the ascending flight beginning at plane 9 on the first floor and ending at plane 9 on the second floor landing, and where the total rise between floors is 210 inches, the following chart displays the distances of link-to-axle connections from respective axes, and riser heights from the floor. In this chart, various parameters are defined as follows:

AXLE: The axle of the step counting from plane 9 at landing 1.

RISE: The vertical distance in inches from the tread top of one step to the tread top of the next succeeding step.

X out: The distance of the outboard link connection to the axle measured from plane 9.

Y out: The distance from the outboard link connection to the axle measured from the vertical plane 12.

Z: The vertical distance of the tread top from landing 1.

Y: The angle of the step axle shaft measured horizontally with respect to vertical plane 9.

X in: The distance of the inboard link-to-axle connection from the plane 9.

Y in: The distance of the inboard link-to-axle connection from plane 12.

The X and Y coordinate references are shown on FIG. 3.

| AXLE/RISE | X out | Y out | Z | γ | X in | Y in |
|---|---|---|---|---|---|---|
| 1/0 | 7.5 | −162.8836 | 0 | 1.9845 | 5.8378 | −114.9124 |
| 2/0 | 22.4640 | −161.8454 | 0 | 5.9534 | 17.4855 | −114.1043 |

-continued

| AXLE/RISE | X out | Y out | Z | γ | X in | Y in |
|---|---|---|---|---|---|---|
| 3/0 | 37.3203 | −159.7739 | 0 | 9.9223 | 29.0493 | −112.4919 |
| 4/.125 | 51.9686 | −156.6839 | .9375 | 13.9012 | 40.4367 | −110.0898 |
| 5/.250 | 66.2812 | −152.6053 | 2.8125 | 17.9106 | 51.5196 | −106.9315 |
| 6/.375 | 80.1317 | −147.5801 | 5.6250 | 21.9724 | 62.1720 | −103.0666 |
| 7/.500 | 93.3954 | −141.6631 | 9.3750 | 26.1112 | 72.2699 | −98.5619 |
| 8/.625 | 105.9490 | −134.9225 | 14.0625 | 30.3560 | 81.6912 | −93.5032 |
| 9/.750 | 117.6702 | −127.4410 | 19.6875 | 34.7425 | 90.3155 | −87.9984 |
| 10/.875 | 128.4382 | −119.3180 | 26.2500 | 39.3169 | 98.0250 | −82.1826 |
| 11/Full | 138.1299 | −110.6740 | 33.75 | 44.1428 | 104.7004 | −76.2289 |
| 12 | 147.0601 | −101.2451 | 41.25 | 48.9688 | 110.8512 | −69.7345 |
| 13 | 155.1654 | −91.0984 | 48.75 | 53.7948 | 116.4339 | −62.7458 |
| 14 | 162.3883 | −80.3057 | 56.25 | 58.6208 | 121.4088 | −55.3121 |
| 15 | 168.6775 | −68.9439 | 63.75 | 63.4467 | 125.7406 | −47.4865 |
| 16 | 173.9887 | −57.0931 | 71.25 | 68.2727 | 129.3988 | −39.3240 |
| 17 | 178.2840 | −44.8374 | 78.75 | 73.0987 | 132.3573 | −30.8827 |
| 18 | 181.5330 | −32.2637 | 86.25 | 77.9247 | 134.5951 | −22.2222 |
| 19 | 183.7127 | −19.4616 | 93.75 | 82.7506 | 136.0964 | −13.4045 |
| 20 | 184.8076 | −6.5213 | 101.25 | 87.5766 | 136.8505 | −4.4917 |

It should be understood that the values shown in the table are repeated in reverse order for the twenty steps in the ascending flight from plane 12 to landing 2. The same organization of values is applicable to the descending flight of steps. It will be noted that the riser height is a uniform maximum for the ten steps from the radius 73 up to plane 12, and for the next ten steps up to radius 76. Then the rise decreases in the order inverse to that shown for the first ten steps.

In addition to providing the smooth curve described above, the aforementioned approach enables maintenance of the flush relationship of the step ends. It also facilitates the use of the interfitting grooved arrangement shown on the riser faces and continuing to the treads. In that connection, and as may be best seen in FIGS. 5A and 5B, both the front and rear edges of the treads, and continuing down the height of the front and rear riser faces is a series of alternate ridges and grooves wherein the ridges and grooves of the trailing edge of one step interfit in a mating fashion with the grooves and ridges of the tread of the next following step. This relationship exists throughout the exposed flights of the steps and discontinues only to some extent during the above-mentioned splaying action under the landings. The smooth transitions from the totally interfitting relationship shown in FIGS. 5A and 5B to the splayed arrangement under the landings, and back to the totally meshing arrangement at the exit of each landing is well achieved by providing a sinusoidal cross-sectional curvature to these ribs and grooves. Other possible curvatures might also be employed but it is believed that the sinusoidal arrangement will remain preferable. In addition, the length of links 31, being constant, maintains the interfitting relationship adjacent the outboard ends of the steps at all times. Thus, they always remain in proper registry with each other providing a flush relationship of the outboard ends thereof at all times, regardless of whether they are under the landings or on an ascending or descending flight. The serpentine configuration of the front and rear faces of the treads causes the illustration in FIG. 4A to look like the top of the treads is curved. Although that can be done, it is not intended here. In the preferred embodiment, the tread tops have the alternating rib and groove cross section as in conventional escalators. One such groove is shown at 17G in FIG. 16.

Figure 13:
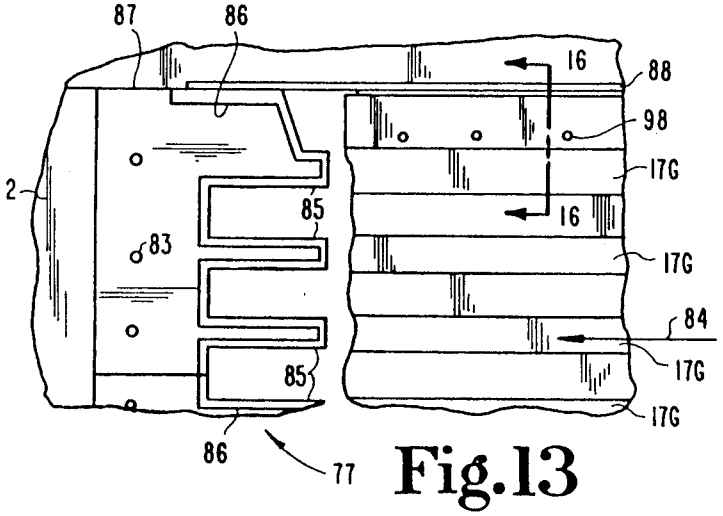
FIG. 13 is a fragmentary plan view of the break-away comb at a landing, and an entering step tread.
Figure 14:
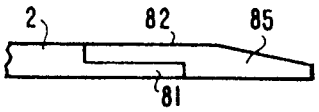
FIG. 14 is a fragmentary side elevational view of the landing plate and stripper comb.

Referring to FIGS. 13 and 14, some details of a safety feature are shown. In FIG. 14, the landing plate 2 is shown with a flange 81 at the bottom of it at the entrance end 77. A comb plate 82 is mounted to this by suitable removable fasteners such as 83. This plate may be in a multiple of small pieces mounted end-to-end and all on top of the flange 81. In any case, whether it be one or a multiple of pieces, each comb has a plurality of fingers 85 extending toward the approaching step moving in the direction of arrow 84. The comb teeth are shaped to be received in grooves 17G in the tread on the step. They are thereby able to strip away any material such as a shoe sole or debris on top of the step and prevent it from moving down under the landing plate. But as a safety measure to prevent wedging and damage to an object or to the escalator, each of the comb fingers has a part of an electrical conductor 86 molded therein, this conductor extending from the edge 87 of the comb plate adjacent conveyor side skirt 88 inwardly to the opposite end of the plate (not shown). This conductor is part of an electrical circuit shown in FIG. 15 and which, when energized by an electrical energy source such as a battery, transformer or other device at 89, maintains the closed condition of a circuit breaker 91 in a supply circuit from a master switch 92 and power source 93 to various drive motors 54M, 59M, and 66M previously described for the step splaying, step closing, and escalator drive system. Consequently, if any object becomes jammed in the comb with any significant force, it will break or bend the tooth sufficiently to break wire 86 and open the holding circuit through relay 91 and thereby open the power supply to all of the motors. The escalator will stop, and all of the step spreading and step closing functions will cease until the object is removed, the comb is replaced and the control circuit thereby made intact again. Thus the conductor 86 may be associated with existing emergency shut-off equipment as is normally required by code for escalators.

Figure 16:
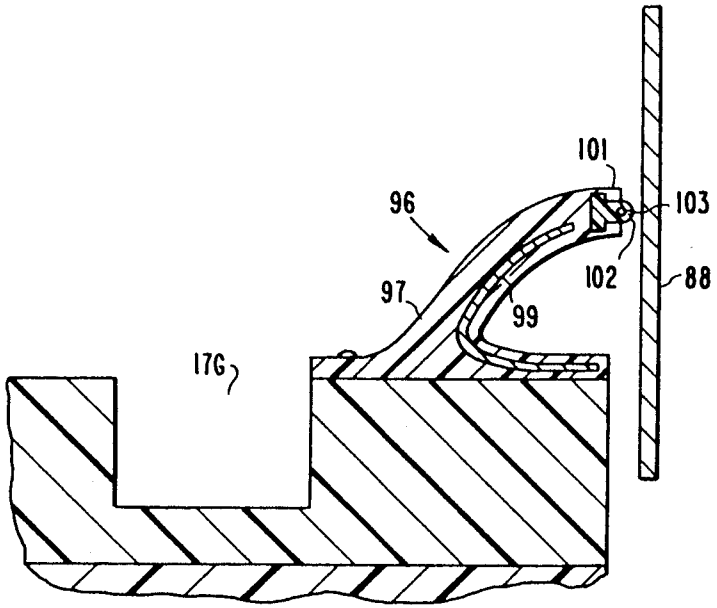
FIG. 16 is a much enlarged fragmentary sectional view through a portion of a step core and tread and showing the skirt guard feature.

Some additional features of this invention can be appreciated with further reference to FIG. 6, together with FIGS. 13 and 16. At each side of the stairway there is a protective skirt as at 88 in FIG. 6 and 13 and 16. This is typically a stainless steel member, but might be made of other materials In any case, it is desirable that the steps not rub against the skirt as they ascend or descend between landings. But it is also desirable to avoid excessive space between the end of the step and the skirt. According to another feature of this invention, a skirt guard 96 is provided at the outer edge of each of the treads. It includes a plastic member 97 which is fastened to the top of the tread by a series of screws 98

(FIG. 13) just as the step treads are fastened to the step cores. The skirt guard has a molded-in metal spring 99 to maintain the proper attitude of the skirt guard as shown in FIG. 16 and prevent it from being mashed down and wedged between the end of the tread and the skirt 88. The distal edge 101 of the skirt guard has a groove in it receiving a low-friction plastic strip made of a Teflon brand or similar material, for example, 102 whose outer edge is spaced approximately one sixteenth inch nominally from the skirt 88. Thus, if there is some lateral movement of the step between the skirts 88 on the opposite sides of the path, the skirt guard strips 102 can limit the amount of such travel. However, if this is too extensive or occurs for too long a time, the outer edge of the strip 102 will wear down and expose the indicator marker 103 to rub on the skirt. This can be a marker material of a wax crayon or other suitable material for obviously marking the skirt and thus indicating to the operator that the escalator may be in need of servicing as a result of wear from long usage.

Figure 17:
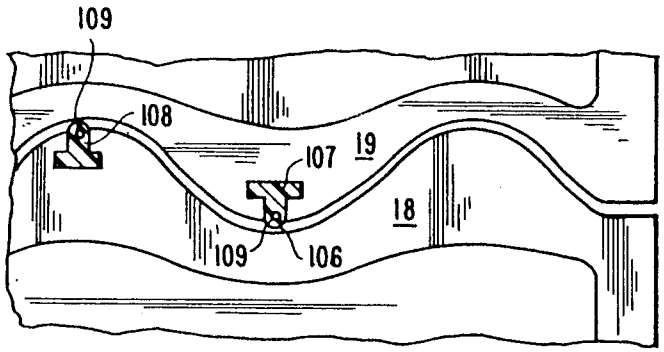
FIG. 17 is a top plan view on the same scale as FIG. 16 showing portions of two adjacent step cores with the treads removed to show the step-to-step spacer strips and wear indicators.

A feature similar to that just described for the skirt guard is also provided between the facing surfaces of adjacent steps. For example, referring to FIG. 17, the tops of two adjacent step cores with the treads removed, are shown fragmentarily. The rear wall 19 of the one step is immediately ahead of the front wall 18 of the following step. At the "top" of the ridge in each of the steps, there is a slot through which an edge 106 of an insert strip of low-friction material protrudes. This strip is received in a T-shaped slot in the wall of the core as shown. In a manner similar to that described above for the strip 102, strips 107 and 108 have a core 109 of marker material. If the spaces between the adjacent faces of the steps close up so that the tread edge of one step consistently rubs against the riser of the next adjacent step for too long, the insert strips 107 and 108 will become worn such that the marker material is exposed at the worn face of the strip and will mark the edge of the tread which is wearing upon it. Thus, the operator of the escalator can be alerted to the need for maintenance.

Figure 18:
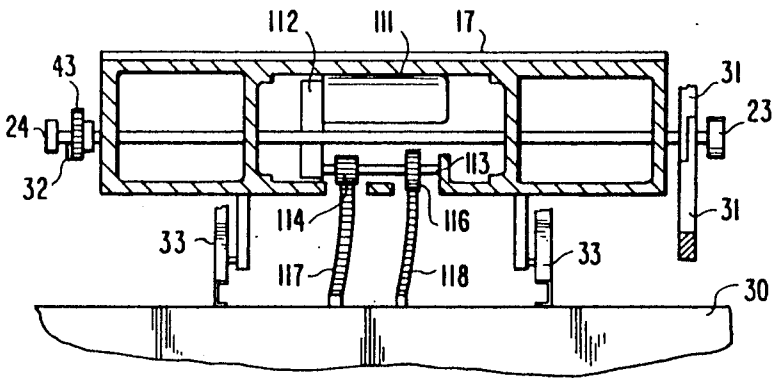
FIG. 18 is a cross-sectional view similar to a portion of FIG. 6, but showing an alternate embodiment of the step with built-in drive motor and gear set.

One method for drive of the escalator was described above. Another method can be described with reference to FIG. 18. In this embodiment, the step construction is essentially the same as in the previous embodiment, so corresponding parts are given the same reference numerals. The steps are mounted in the assembly in the same way. However, instead of having a belt drive as described above with reference to FIG. 12, in this embodiment each step has a motor 111 in it and a reduction unit 112. The output shaft 113 for the reduction unit has two gears, 114 and 116, mounted on it. These gears operate on racks 117 and 118, respectively, which are secured to the plates 30 on the support tube 7. Gear 116 is slightly larger in diameter, with the size and number of teeth dependent upon the greater distance through which it must travel as it follows the curved path while ascending and descending between the landings. The racks may be employed through both of the curved paths, but are not needed at the landings since there are always a sufficient number of motors operating to adequately move the escalator. The electrical power for the motors may be provided by third rail techniques possibly using one or both of the racks 116 and 117 or any one of other possibilities associated with the guides such as 33 and 41, for example. It might not be necessary to have a motor in each step. For example, a motor in every fourth step or so, might be adequate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An escalator having a plurality of steps in series and moving in a curved path, with each step having an inboard end and an outboard end, and links at the ends of the steps connecting each step to the next adjacent step in the series, the improvement comprising:

a drive system including a drive belt separate from and engageable with said links and belt engager means on at least some of the links and engageable with the belt when the links move into registry with the belt for driving the series of steps by imputing drive force from said drive belt to said belt engager means on said links, whereby drive force is imputed from said links to said series of steps.

2. The improvement of claim 1 and wherein the belt is a positive drive belt, and the belt engager means are positive drive rack means, and wherein said belt engager means are located on inboard links connecting said inboard ends of adjacent steps, and wherein said inboard links include means for spreading and closing said inboard ends of adjacent steps.

3. The improvement of claim 2 and wherein the belt is a chain, and the engager means is a sprocket rack.

4. In a structure having two vertically spaced floors for occupancy by people and having an escalator operating between a landing area on one floor and a landing area on the other floor, the escalator improvement comprising:

a series of adjacent steps operating on generally curved paths between said landing area on one of said floors and said landing area on the other of said floors, one of said paths being an ascending path and the other of said paths being a descending path, with links connecting adjacent steps in the series, each step having an inboard end which moves along the inside margins of the curved paths and an outboard end which moves along the outside margins of the curved paths;

means coupled to said steps to move said steps into spaces under the landing areas; and positive drive means on said steps to alternately spread and close the inboard ends of adjacent steps as the steps descend to and ascend from, respectively, the spaces under said landing areas wherein said positive drive means include:

a crank mounted to each step and rotatable about an axis extending through the ends of the step, said crank being located adjacent the inboard end of the step and having one end of one of said links connected to it; and a gear mounted in driving relation to said crank for driving said crank about said axis.

5. The improvement of claim 4 and further comprising:

gear drivers located adjacent opposite ends of said landing areas and engageable with said gears, the location of the drivers being such that the gear for a step is engaged by a step spreading driver as the step approaches a landing from one of said paths, and the gear is engaged by a step closing driver as the step approaches one of said paths from the space under the landing.

6. The improvement of claim 5 and wherein:
the step drivers are endless drive belts.

7. The improvement of claim 6 and wherein:
said endless drive belts are gear belts.

8. The improvement of claim 6 and wherein:
said endless belts are powered so that a flight of the belt that is engaged by said gears is moving in a direction the same as the direction of movement of the step to which the engaged gear is mounted to effect an alpha degree rotation of the gear in a step spreading direction as the step approaches a landing, and to effect a three hundred sixty minus alpha degree rotation in the opposite, step closing direction as the step approaches one of said paths from the space under the landing.

9. In a people mover having a series of adjacent treads supported on cores and operating on generally curved paths between landing areas and having moving handrails above said paths, the improvement comprising:
links connecting adjacent tread cores in the series, each tread having first and second ends;
means coupled to said tread cores to move said treads into spaces under the landing areas; and
positive powered drive means on said tread cores to alternately spread and close corresponding ends of adjacent treads as the treads descend to and ascend from, respectively, the spaces under said landing areas, wherein said powered drive means includes a drive gear mounted along an inboard edge of said tread cores for closing said ends of adjacent treads.

10. The improvement of claim 9 and wherein said treads have:
leading and trailing edges, each edge having a series of adjacent ribs and grooves, the ribs on the trailing edge of one tread engaging the grooves on the leading edge of the next following tread, and
the ribs and grooves having curved surfaces to facilitate maintenance of the interfitting relationship of the ribs and grooves at corresponding first ends of the treads during spreading and closing of corresponding second ends of the treads.

11. The improvement of claim 10 and wherein the shape of the interfitting ribs and grooves is sinusoidal.

12. The improvement of claim 10 and wherein:
the landing areas are on vertically spaced levels, and the paths are ascending and descending between levels, and the cores and treads comprise steps of an escalator, and the cores and treads are arranged such that each step has one of said cores with one of said treads on top of the core,
the cores having front and rear riser faces, the riser faces having series of vertically extending adjacent ribs and grooves continuing downward from the said ribs and grooves in the leading and trailing edges of the treads.

13. The improvement of claim 9 and wherein:
each of said treads is removably fastened to the top of one of said cores.

14. The improvement of claim 13 and wherein:
said conveyor has a drive circuit;
said treads have grooves in the top surfaces thereof extending in the direction of movement of the tread into a landing area; and
said landing areas have tread entrance edges, said tread entrance edges having stripper combs thereon with comb teeth having distal ends extending into said grooves;
said teeth having continuous electrical conductors therein severable upon deformation of a tooth to interrupt the conveyor drive circuit.

15. The improvement of claim 13 and further comprising:
side skirts along the sides of said paths adjacent the ends of said treads; and
skirt guards mounted to the tops of said treads adjacent said first and second ends of the treads, each skirt guard having a lip extending upwardly and outwardly from the top of the tread and having a distal edge adjacent said skirt guard, said lip being resiliently biased upwardly to inhibit folding downward of said edge toward said tread.

16. The improvement of claim 15 and further comprising:
an insert of low-friction plastic in said distal edge and nominally spaced about 1/16 inch from said skirt guard.

17. In a people mover having a series of adjacent treads supported on cores and operating on generally curved paths between landing areas and having moving handrails above said paths, the improvement comprising:
links connecting adjacent tread cores in the series, each tread having first and second ends;
means coupled to said tread cores to move said treads into spaces under the landing areas;
positive drive means on said tread cores to alternately spread and close corresponding ends of adjacent treads as the treads descend to and ascend from, respectively, the spaces under said landing areas; and
tread core support means under one of said landing areas and normally supporting the cores for horizontal movement under the one landing area,
said support means having a partial hiatus therein permitting said links to support a core as the core traverses the hiatus, whereby a change in linear velocity of the mover at the one landing area is compensated,
said tread core support means having means for maintaining a horizontal attitude of the tread during the period that the tread core is supported by the links as the tread traverses the hiatus.

18. In a people mover having a series of adjacent treads supported on cores and operating on generally curved paths between landing areas and having moving handrails above said paths, the improvement comprising:
links connecting adjacent tread cores in the series, each tread having first and second ends;
means coupled to said tread cores to move said treads into spaces under the landing areas;
positive drive means on said tread cores to alternately spread and close corresponding ends of adjacent treads as the treads descend to and ascend from, respectively, the spaces under said landing areas;
leading and trailing edges, each edge having a series of adjacent ribs and grooves, the ribs on the trailing edge of one tread engaging the grooves on the leading edge of the next following tread,
the ribs and grooves having curved surfaces to facilitate maintenance of the interfitting relationship of the ribs and grooves at corresponding first ends of the treads during spreading and closing of corresponding second ends of the treads;

wherein the landing areas are on vertically spaced levels, and the paths are ascending and descending between levels, and the cores and treads comprise steps of an escalator, and the cores and treads are arranged such that each step has one of said cores with one of said treads on top of the core, the cores having front and rear riser faces, the riser faces having series of vertically extending adjacent ribs and grooves continuing downward from the said ribs and grooves in the leading and trailing edges of the treads; and step space monitor means including tabs located in the riser faces and projecting into spaces between the riser of one step and one of said edges of the tread of the next adjacent step.

19. The improvement of claim 18 and wherein:

said tabs include marking material therein to mark the tread edge of the next adjacent step when the monitor means becomes worn more than an acceptable predetermined amount to thereby indicate that there has been undesirable wear in the series of steps resulting in less than desired spacing between edges of adjacent treads.

20. In a people mover having a series of adjacent treads supported on cores and operating on generally curved paths between landing areas and having moving handrails above said paths, the improvement comprising:

links connecting adjacent tread cores in the series, each tread having first and second ends;

means coupled to said tread cores to move said treads into spaces under the landing areas;

positive drive means on said tread cores to alternately spread and close corresponding ends of adjacent treads as the treads descend to and ascend from, respectively, the spaces under said landing areas; and, a crank mounted to each tread core and rotatable about an axis extending through the ends of the tread core, said crank being located adjacent the first end of the tread core and having one end of one of said links connected to it; and a gear mounted in driving relation to said crank for driving said crank about said axis.

21. The improvement of claim 20 and further comprising:

gear drivers located adjacent opposite ends of said landing areas and engageable with said gears, the location of the drivers being such that the gear for a core is engaged by a tread spreading driver as the tread approaches a landing from one of said paths, and the gear is engaged by a tread closing driver as the tread approaches one of said paths from the space under the landing.

22. The improvement of claim 21 and wherein:

the gear drivers are endless drive belts.

23. The improvement of claim 22 and wherein:

said endless belts are powered so that a flight of the belt that is engaged by said gears is moving in a direction relative the direction of movement of the tread to which the engaged gear is mounted to effect an alpha degree rotation of the gear in a tread spreading direction as the tread approaches a landing, and to effect three hundred sixty minus alpha degree rotation in the opposite, tread closing direction as the tread approaches one of said paths from the space under the landing.

24. In a people mover having a series of adjacent treads supported on cores and operating on generally curved paths between landing areas and having moving handrails above said paths, the improvement comprising:

links connecting adjacent tread cores in the series, each tread having first and second ends;

means coupled to said tread cores to move said treads into spaces under the landing areas;

positive drive means on said tread cores to alternately spread and close corresponding ends of adjacent treads as the treads descend to and ascend from, respectively, the spaces under said landing areas; and wherein each of said treads is removably fastened to the top of one of said cores;

drive motors in at least some of said cores and driving powered drive transmitting members;

and stationary drive tracks along said paths and engaged by said members to drive said cores along said paths.

25. The improvement of claim 24 and wherein:

said drive members are toothed wheels; and said drive tracks are toothed tracks mating with said wheels whereby rotation of said wheels moves said cores along said tracks.

26. In a people mover having a series of adjacent treads supported on cores and operating on generally curved paths between landing areas and having moving handrails above said paths, the improvement comprising:

links connecting adjacent tread cores in the series, each tread having first and second ends;

means coupled to said tread cores to move said treads into spaces under the landing areas;

positive drive means on said tread cores to alternately spread and close corresponding ends of adjacent treads as the treads descend to and ascend from, respectively, the spaces under said landing areas; and, wherein each of said treads is removably fastened to the top of one of said cores;

side skirts along the sides of said paths adjacent the ends of said treads;

skirt guards mounted to the tops of said treads adjacent said first and second ends of the treads, each skirt guard having a lip extending upwardly and outwardly from the top of the tread and having a distal edge adjacent said skirt guard, said lip being resiliently biased upwardly to inhibit folding downward of said edge toward said tread;

an insert of low-friction plastic in said distal edge and nominally spaced about 1/16 inch from said skirt guard; and a marker material in said insert and exposable upon predetermined amount of wear of said insert by engagement with said skirt to non-destructably mark the skirt to indicate need to change the insert.

27. In a structure having two vertically spaced floors for occupancy by people and having an escalator operating between a landing area on one floor and a landing area on the other floor, the escalator improvement comprising:

a series of adjacent steps operating on a path between said landing area on one of said floors and said landing area on the other of said floors, one of said paths being an ascending path and the other of said paths being a descending path;

guide means guiding said steps along said paths;

support means connected to said guide means and supporting said guide means and including tubes, each tube having one mounting location adjacent the landing area on one of said floors, and each tube having another mounting location adjacent the landing area on the other of said floors;

wherein said paths are curved; and said tubes are curved and are centrally located under said paths.

28. The improvement of claim 27 and wherein:

there is only one of said tubes under the ascending path and only one of said tubes under the descending path.

29. In a structure having two vertically spaced floors for occupancy by people and having an escalator operating between a landing area on one floor and a landing area on the other floor, the escalator improvement comprising:

a series of adjacent steps operating on generally curved paths between said landing area on one of said floors and said landing area on the other of said floors, one of said paths being an ascending path and the other of said paths being a descending path, with links connecting adjacent steps in the series, each step having an inboard end which moves along the inside margins of the curved paths and an outboard end which moves along the outside margins of the curved paths;

means coupled to said steps to move said steps into spaces under the landing areas;

positive drive means on said steps to alternately spread and close the inboard ends of adjacent steps as the steps descend to and ascend from, respectively, the spaces under said landing areas;

step stabilizer legs projecting downward from each of the steps in the series and including front and rear rollers thereon;

guide tracks under the series of steps in the ascending path and under the series of steps in the descending path, the front rollers on the stabilizer legs being guidingly received in the guide tracks under the steps in the ascending path, and the rear rollers being guidingly received in the guide tracks under the descending path of steps, whereby the tops of the steps have a horizontal attitude maintained therein during ascent up the ascending path and during descent down the descending path;

escalator drive means including second positive drive means on said steps and engaging rack means supported in the structure;

wherein said steps comprise open-topped cores having treads fastened thereto, the treads having leading and trailing edges with each edge having a series of adjacent ridges and grooves, the ridges on the trailing edge of one tread interfitting with the grooves on the leading edge of the next following tread, the ridges and grooves having curved surfaces to facilitate maintenance of the interfitting relationship of the ridges and grooves at corresponding outboard ends of said treads during spreading and closing of corresponding inboard ends of the treads;

side skirts mounted in the structure at each side of each of said curved paths, with moving handrails mounted above said side skirts;

skirt guards mounted atop said treads at each end of the tread, each skirt guard including a flexible plastic lip material having a generally C-shaped cross-section with a metal spring member therein having a C-shaped cross-section and maintaining the desired cross-sectional shape of said skirt guard;

said skirt guard having a distal edge with a groove therein; and a low-friction plastic strip received in said groove in said skirt guard edge and having embedded therein a marker material whereby, upon predetermined wear of the skirt guard edge against the skirt, said marker material is exposed to mark the skirt.

30. The improvement of claim 29 and wherein:

said escalator has a drive circuit;

said treads have grooves in the top surfaces thereof extending in the direction of movement of the tread into a landing area; and at least one of said landing areas has a tread entrance edge, said tread entrance edge having a stripper comb thereon with comb teeth having distal ends extending into said grooves;

said teeth having a continuous electrical conductor therein severable upon deformation of a tooth to interrupt the escalator drive circuit.

31. The improvement of claim 30 and further comprising:

support means connected to said guide means and supporting said guide means and including tubes, each tube having one mounting location adjacent the landing area on one of said floors, and each tube having another mounting location adjacent the landing area on the other of said floors.

32. In a structure having two vertically spaced floors for occupancy by people and having an escalator operating between a landing area on one floor and a landing area on the other floor, the escalator improvement comprising:

a series of adjacent steps operating on a path between said landing area on one of said floors and said landing area on the other of said floors;

escalator drive means driving said steps along the path;

said steps having treads fastened thereto, the treads being readily removable and replaceable for renovation;

side skirts mounted at each side of each of said path, with moving handrails mounted above said side skirts;

skirt guards mounted atop said treads at each end of the tread, each skirt guard including a flexible plastic lip material having a generally C-shaped cross-section with a metal spring member therein having a C-shaped cross-section and maintaining the desired cross-sectional shape of said skirt guard;

said skirt guard having a distal edge with a groove therein; and a low-friction plastic strip received in said groove in said skirt guard edge and having embedded therein a marker material whereby, upon predetermined wear of the skirt guard edge against the skirt, said marker material is exposed to mark the skirt.

33. In a structure having two vertically spaced floors for occupancy by people and having an escalator operating between a landing area on one floor and a landing area on the other floor, the escalator improvement comprising:

a series of adjacent steps operating on a path between said landing area on one of said floors and said landing area on the other of said floors;

escalator drive means driving said steps along the path;

said steps having treads fastened thereto, the treads being readily removable and replaceable for renovation;

said escalator has a drive motor inside at least one of said steps for driving the escalator steps along said path.

34. In a people mover having a series of adjacent treads operating on generally curved paths between landing areas, the improvement comprising:

links connecting adjacent treads in the series, each tread having first and second ends;

means coupled to said treads to move said treads into spaces under the landing areas;

tread support means under one of said landing areas and normally supporting the treads for horizontal movement under the one landing area, said support means having a partial hiatus therein permitting said links to support a tread as the tread traverses the hiatus, whereby a change in linear velocity of the treads at the one landing area is compensated, said tread support means having means for maintaining a horizontal attitude of the tread during the period that the tread is supported by the links as the tread traverses the hiatus.

35. The improvement of claim 34 and wherein said means for maintaining the horizontal attitude includes:

guide track means under the treads and having first and second sections at the location of said partial hiatus, said first section being hinged to swing downward at said location and said second section being hinged to said first section to remain horizontal under said landing area; and track follower means fastened to the bottom of said treads and engaged by said first and second track sections in sequence as said hiatus is traversed by the tread to maintain the tread in a horizontal attitude.

36. The improvement of claim 35 and wherein said means for maintaining the horizontal attitude further includes:

additional guide track means under said treads and having first and second sections hinged to each other, with means for maintaining said first section horizontal as said second section pivots downward and upward, second track follower means fastened to the bottom of said treads and engaged by said first and second sections of said additional track means in sequence as said hiatus is traversed by the tread to maintain the tread in a horizontal attitude; the first section of said additional track means having a curved entrance end for smooth engagement with said second track follower means.

* * * * *

UNITED STATES PATENT AND TRADEMARK OFFICE

CERTIFICATE OF CORRECTION

PATENT NO. : 5,052,539

DATED : October 1, 1991

INVENTOR(S) : Geoffrey S. Fillingsness, et al.

Figure 20:
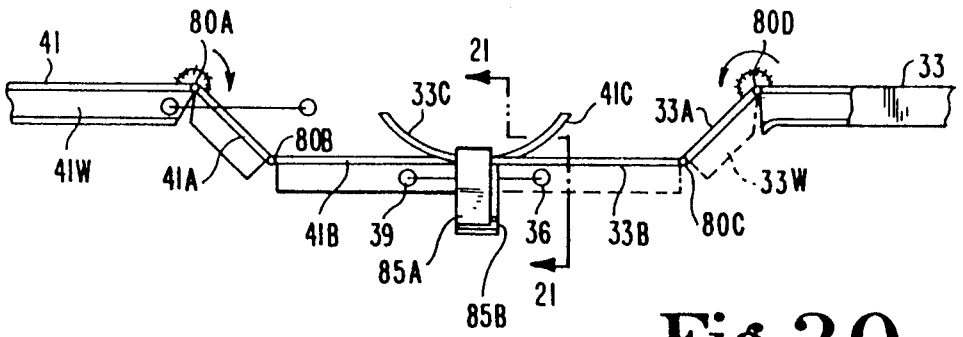
FIG. 20 is a detailed view of the step attitude control components of FIG. 19.

It is certified that error appears in the above-identified patent and that said Letters Patent is hereby corrected as shown below:

In column 2, line 51, please begin "FIG. 20" as a new paragraph

Figure 21:
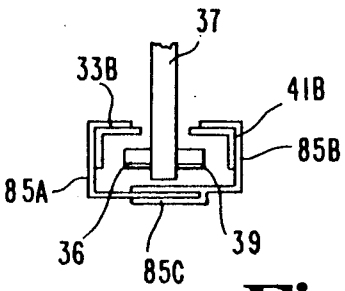
FIG. 21 is a cross section taken at line 21—21 in FIG. and viewed in the direction of the arrows.

In column 2, line 52, please begin "FIG. 21" as a new paragraph

In column 2, line 53, please insert --20-- after "FIG."

Figure 22:
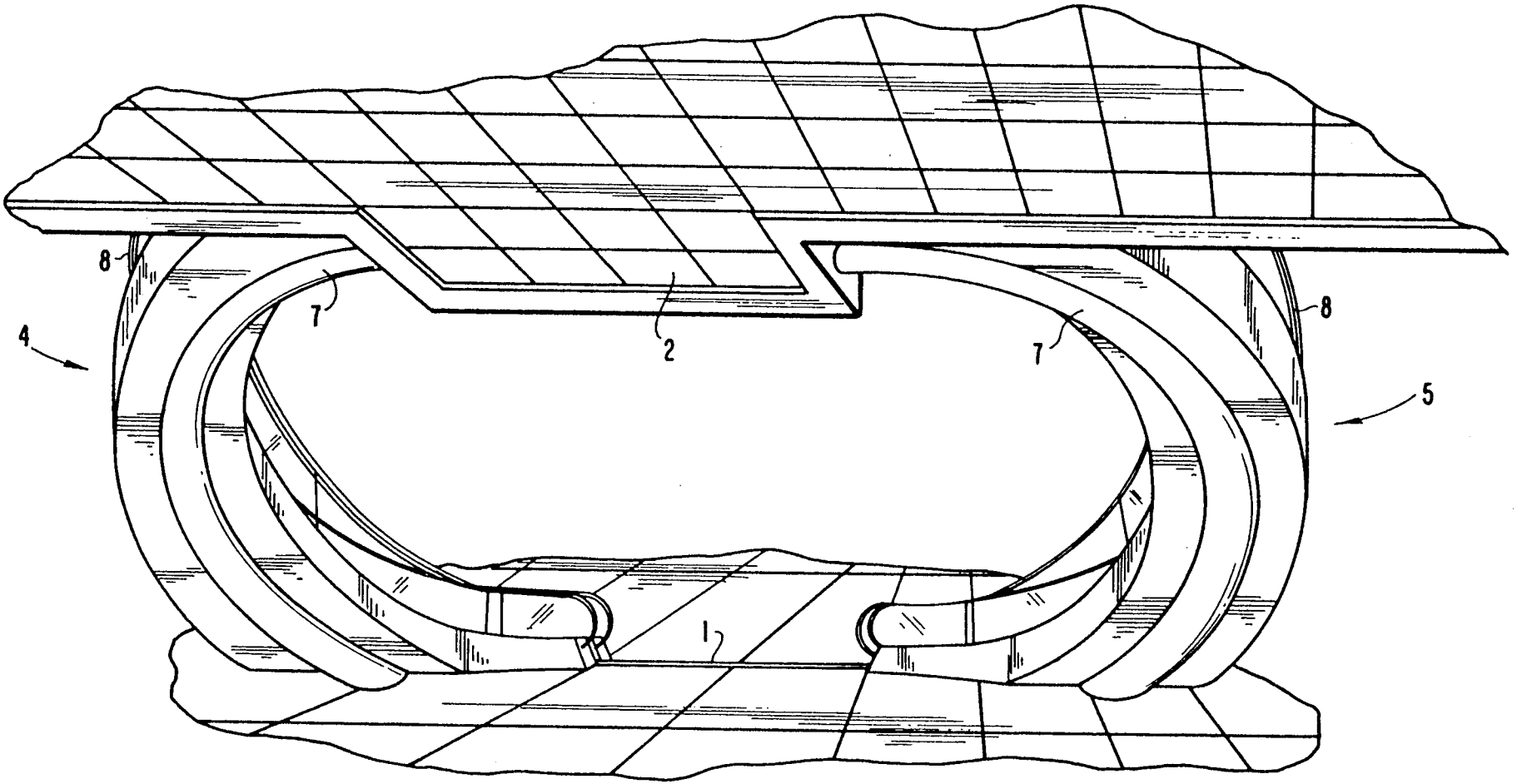
FIG. 22 is a rear pictorial view of a curved escalator installation according to our invention.

In column 2, line 54, please begin "FIG. 22" as a new paragraph

In column 6, line 35, "Provided" should read --provided--

In column 10, line 61, please insert --.-- after "materials"

Signed and Sealed this

Nineteenth Day of October, 1993

Bruce Lehman

*Attest:*

BRUCE LEHMAN

*Attesting Officer*

*Commissioner of Patents and Trademarks*